US005878985A

United States Patent [19]

Iannone

[11] Patent Number: 5,878,985

[45] Date of Patent: Mar. 9, 1999

[54] SHIM FOR WINDOW TREATMENT BRACKET

[76] Inventor: James R. Iannone, 6216 Landis Ave., Sea Isle City, N.J. 08243

[21] Appl. No.: 822,105

[22] Filed: Mar. 21, 1997

[51] Int. Cl.[6] ..... A47B 96/06

[52] U.S. Cl. ..... 248/205.1; 52/126.1

[58] Field of Search ..... 248/205.1, 207, 248/208, 224.8, 222.41, 225.11, 300, 188.2; 52/126.1, 126.5, 211, 215, 217

[56] References Cited

U.S. PATENT DOCUMENTS

| | | | |
|---|---|---|---|
| 1,492,210 | 4/1924 | Kelly et al. | 248/254 |
| 1,915,320 | 6/1933 | Jones | 248/188.2 |
| 4,136,847 | 1/1979 | Murray | 248/256 |
| 4,299,369 | 11/1981 | Colich, Sr. | 248/263 |
| 4,400,920 | 8/1983 | Logsdon | 52/126.1 |
| 4,625,489 | 12/1986 | Bögle | 52/712 |
| 4,713,922 | 12/1987 | Ingold | 52/656.2 |
| 4,731,965 | 3/1988 | Jensen | 52/126.1 |
| 4,830,320 | 5/1989 | Bellows | 248/188.2 |
| 4,858,865 | 8/1989 | Schrepfer | 248/188.2 |
| 4,911,270 | 3/1990 | Hudson | 188/32 |
| 5,054,250 | 10/1991 | Foss | 52/126.1 |
| 5,307,860 | 5/1994 | Wilkinson et al. | 160/348 |

OTHER PUBLICATIONS

R.H. Rowley Co., Jan. 1, 1996 (Advertisement for Mini–Blind Bracket Spacers).

*Primary Examiner*—Leslie A. Braun
*Assistant Examiner*—Anita M. King
*Attorney, Agent, or Firm*—Norman E. Lehrer

[57] ABSTRACT

The shim of the present invention is preferably molded from plastic or the like and has a planar front surface of a width substantially equal to the width of an L-bracket and a height which is substantially equal to the height of the wood molding to which it is intended to be secured. The rear face of the shim has a pattern formed thereon which is complementary to or the negative of the shape of the face of the molding. Thus, when the shim is placed onto the molding, the planar front surface is essentially vertical. A plurality of elongated slots are formed through the shim between the front and rear surfaces thereof to accommodate mounting hardware for the L-brackets or similar hardware. Utilizing the shims of the present invention essentially guarantees that the mounting hardware for drapes or blinds or other window treatments will be properly oriented.

6 Claims, 1 Drawing Sheet

SHIM FOR WINDOW TREATMENT BRACKET

BACKGROUND OF THE INVENTION

The present invention is directed toward a plastic molded shim and more particularly toward such a shim which is adapted to be mounted to the molding around a window or door to create a planar surface for mounting a window treatment bracket thereto.

Window treatments such as drapes or blinds or the like are commonly supported by metal brackets attached to the area of the wall around the window or door. These brackets can either be attached to the wall itself or to the molding which surrounds the door or window. Mounting the brackets to the wall is sometimes difficult since the walls may be made of plasterboard or the like which does not provide significant anchoring support for the brackets. It is, therefore, frequently desirable to secure the brackets to the wooden frames surrounding the window or door. These solid wooden frames frequently provide better anchoring security for the brackets.

As is well known in the art, however, moldings frequently used around windows or doors do not present vertical planar surfaces. Rather, they are normally decorative in nature and frequently are thicker at their outer edge away from the window or the door than at the inner edge which is adjacent the window opening. The unevenness of such molding creates a significant problem when installing the brackets or other hardware for drapes or blinds as anyone who has ever attempted to do so has undoubtedly experienced.

The primary problem with the use of decorative type window moldings results primarily from the horizontally extending molding located above the window or door. Most hardware and similar brackets used for drapes and blinds are normally in the form of a metal L-bracket which, when properly mounted and oriented, has a vertical leg and a horizontally extending leg. The vertical leg normally has a substantially planar rear vertical surface that is adapted to be secured to the wall or molding so that the horizontal surface can extend into the room for supporting the rods or tracks or the like which, in turn, support the drapes or blinds. Obviously if the L-bracket is not mounted so that its rear surface is substantially vertical, the horizontal leg of the same will be tilted and the drapes or blinds cannot be properly hung.

If the horizontal molding above a door or window is not substantially planar, there is no planar surface to which the L-bracket can be mounted. The brackets, therefore, cannot be mounted directly to the molding and in proper orientation.

Window treatment installers have, from time to time, wedged small pieces of wood or metal or the like between the lower end of the L-brackets and the molding so as to space the lower end of the bracket from the molding in order to make the same vertical. This, however, is a haphazard type of cure as the spacer can become dislodged. Furthermore, there is no guarantee of uniformity amongst the brackets and there is no way to insure that each of the multiple brackets being mounted to the molding will be in substantial alignment with the others.

SUMMARY OF THE INVENTION

The present invention is designed to overcome the deficiencies of the prior art described above. The invention is directed toward a shim which is preferably molded from plastic or the like and which has a planar front surface of a width substantially equal to the width of an L-bracket and a height which is substantially equal to the height of the wood molding to which it is intended to be secured. The rear face of the shim has a pattern formed therein which is complementary to or the negative of the shape of the face of the molding. Thus, when the shim is placed onto the molding, the planar front surface is essentially vertical. A plurality of elongated slots are formed through the shim between the front and rear surfaces thereof to accommodate mounting hardware for the L-brackets or similar hardware. Utilizing the shims of the present invention essentially guarantees that the mounting hardware for the drapes or blinds will be properly oriented.

BRIEF DESCRIPTION OF THE DRAWING

For the purpose of illustrating the invention, there is shown in the accompanying drawing one form which is presently preferred; it being understood that the invention is not intended to be limited to the se arrangements and instrumentalities shown.

DETAILED DESCRIPTION OF THE PREFERRED EMBODIMENT

Figure 1:
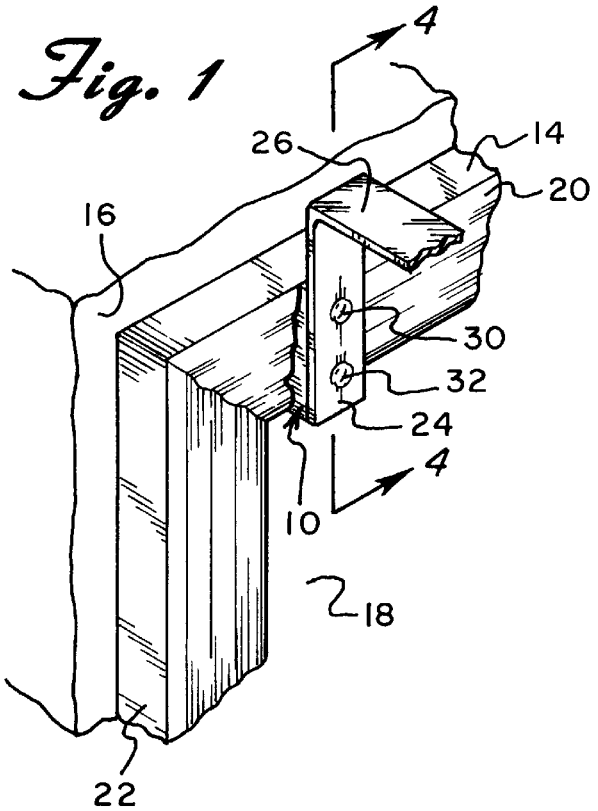
FIG. 1 is a front and top perspective view, with portions broken away, showing the manner in shim of the present invention is utilized on a window frame.
Figure 2:
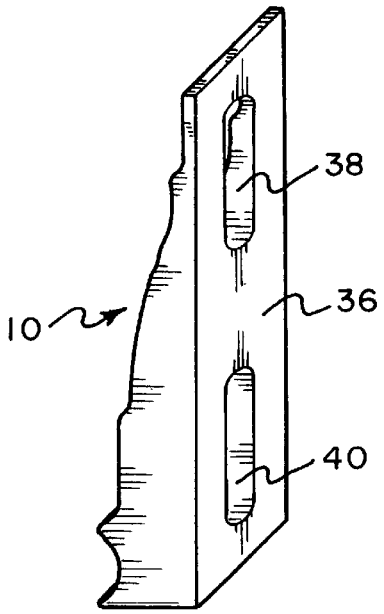
FIG. 2 is a front and side perspective view of a shim, per se, constructed in accordance with the principles of the present inventions.

Referring now to the drawing in detail wherein like reference numerals have been used throughout the various figures to designate like elements, there is shown in the figures a shim for mounting window treatment hardware or the like constructed in accordance with the principles of the present invention and designated generally as 10. The shim 10 is intended to be used to help secure an L-bracket 12 to the wooden molding 14 which is secured to a wall 16 around a window opening 18 or the like. As shown in FIG. 1, the window molding 14 is normally comprised of a horizontal portion 20 that is located above the window and at least one vertically extending window molding portion 22 mounted to the wall 16 adjacent a side of the window opening 18. The present invention is primarily concerned with securing the L-bracket 12 to the upper molding 20 although there may be occasions when the same could also be utilized with the side moldings 22.

Although the drawings specifically depict an L-bracket 12 as the mounting hardware for use with the shim 10 of the present invention, it should be understood that this is by way of example only. The shims of the present invention can also be utilized to help properly mount a wide variety of other types of mounting hardware which, in turn, are used to secure drapes, blinds and other window treatments to the frame or molding 14. In any case, the mounting hardware such as the L-bracket 12 includes a vertically extending and substantially planar leg 24. Extending forwardly at a right angle from the leg 24 is a horizontal leg 26 from which the window treatment is normally suspended. The vertical leg 24 also includes spaced-apart apertures 26 and 28 therein through which screws 30 and 32 can pass in order to mount the L-bracket 12 in position.

Figure 4:
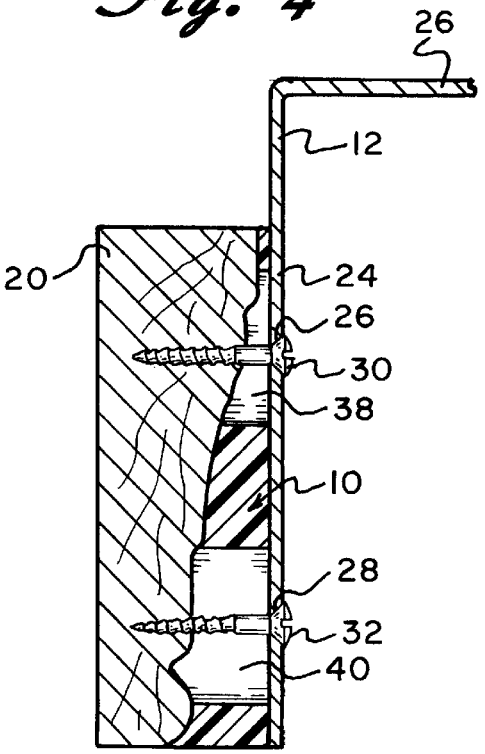
FIG. 4 is a cross-sectional view taken through line 4—4 of FIG. 1.
Figure 3:
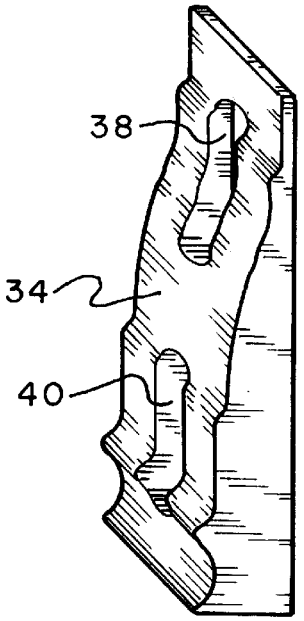
FIG. 3 is a rear side perspective view thereof.

The window molding 14 is normally decorative on its front face and, as best seen in FIG. 4, frequently is thicker at its top or outside edge and thinner at its lower or inside edge, i.e. the edge closer to the window opening 18. The molding 14 shown in the figures is a commonly used colonial style molding. However, it should be readily apparent that the present invention is not intended to be limited to the particular molding that is shown. There are, of course, less ornate moldings such as simple clam shell moldings wherein the face of the molding is substantially continuously curved and has the appearance of half of a clam shell. In all cases, however, the molding is generally thicker at its top or outer edge than at its lower or inner edge. And, as should be readily apparent from FIG. 4, if the L-bracket 12 were to be mounted directly to the molding 20, the leg 24 of the L-bracket would not be vertical and the leg 26 would not be horizontal. As a result, the window treatment would not be properly hung.

The shim 10 of the present invention is intended to be inserted between the L-bracket 12 and the molding 20 so as to present a substantially planar vertical surface to which the vertical leg 24 of the L-bracket 12 can be mounted. This is accomplished by providing the rear face 34 of the shim 10 with a surface that is essentially complementary to or the negative of the surface of the window molding 14. That is, for every recess in the molding 14 there is a raised portion on the shim 10 and for every raised portion on the molding 14 there is a recess in the shim 10. In this way, the rear surface 34 is intended to fit onto or mate with the front surface of the window molding 14.

The front surface 36 of the shim 10 is substantially planar. Furthermore, the top of the shim 10 is relatively thin and the same tapers downwardly so that the shim is thicker at the bottom thereof than at the top. As a result, and as can clearly be seen in FIG. 4, when the face 34 of the shim 10 is properly positioned on the molding 14, the front face 36 is substantially vertical. Preferably, the thickness of the shim 10 at the top thereof is ¼" or less so as not to appreciably affect the distance between the L-bracket and the molding 20. The height of the shim 10 may be between 2 to 4" and is preferably the same size as the molding 20 as shown in FIG. 4. The width of the shim 10 is preferably approximately 1" although the same may vary, as desired.

Extending entirely through the shim 10 from the rear face 34 to the front face 36 are a pair of vertically elongated slotted openings 38 and 40. These openings allow the screws 30 and 32 that are mounting the L-bracket 12 to pass therethrough so that they can be affixed to the wooden window molding 20. Because the slots 38 and 40 are elongated, different L-brackets 12 or other types of hardware which may have the apertures formed therein in different positions can be utilized. Furthermore, the elongated openings 38 and 40 allow the L-brackets to be positioned at different vertical levels, as desired.

The shim 10 is preferably made of molded plastic although other materials could be utilized. In any case, a different shim would have to be made for different types of molding. This is not a particularly ominous problem since there are only a very small number of different types of moldings that are actively in use. An installer, therefore, need carry with him only a limited quantity of different shims.

The present invention may be embodied in other specific forms without departing from the spirit or essential attributes thereof and accordingly reference should be made to the appended claims rather than to the foregoing specification as indicating the scope of the invention.

I claim:

1. The combination of a shim and a wooden molding particularly adapted for mounting window treatment hardware thereto the wooden molding comprising a horizontally extending length adopted to be located above a window or door said molding having a top and a bottom, said molding being thicker at its top than at its bottom and having raised and recessed portions thereby presenting a nonplanar surface, said shim being elongated in a vertical direction, having an upper portion and a bottom, and having front and rear opposing surfaces, said front surface being substantially planar, said rear surface being nonplanar and having raised and recessed portions so that said rear surface is substantially complementary to said surface of said molding so as to interfit therewith with the front planar surface being essentially vertically oriented, said shim being thinner from front to back at the upper portion thereof than at the bottom of said shim and at least one vertically extending elongated opening passing through said shim from said rear surface to said front surface thereof.

2. The combination of a shim and a wooden molding as claimed in claim 1, wherein the skin further includes at least two elongated openings passing therethrough.

3. The combination of a shim and a wooden molding as claimed in claim 2 wherein said elongated openings are oriented with one being substantially above the other.

4. The combination of a shim and a wooden molding as claimed in claim 1 wherein the height of said shim is substantially equal to the height of said molding to which it is to be attached.

5. The combination of a shim and a wooden molding as claimed in claim 1 wherein said shim has a width of approximately 1".

6. The combination of a shim and a wooden molding as claimed in claim 1 wherein the upper portion of said shim is less than ¼" thick so as not to appreciably affect the distance between the window treatment hardware and the window molding to which it is to be attached.

* * * * *

UNITED STATES PATENT AND TRADEMARK OFFICE

CERTIFICATE OF CORRECTION

PATENT NO. : 5,878,985

DATED : MARCH 9, 1999

INVENTOR(S) : JAMES R. IANNONE

It is certified that error appears in the above-identified patent and that said Letters Patent is hereby corrected as shown below:

Column 2, line 19, change "se" to --precise--.

Column 2, line 22, after "in" insert --which the--.

Column 4, line 18, change "adopted" to --adapted--.

Column 4, line 35, change "skin" to --shim--.

Signed and Sealed this

Twenty-fourth Day of August, 1999

*Attest:*

Q. TODD DICKINSON

*Attesting Officer*

*Acting Commissioner of Patents and Trademarks*